US005542547A

United States Patent [19]

Ricciardi

[11] Patent Number: 5,542,547

[45] Date of Patent: Aug. 6, 1996

[54] DOCUMENT SORTING SECTION HAVING A PLURALITY OF PRIMARY SORTING PATHS

[75] Inventor: Mario Ricciardi, Glenview, Ill.

[73] Assignee: Bell & Howell Phillipsburg Company, Durham, N.C.

[21] Appl. No.: 265,707

[22] Filed: Jun. 27, 1994

Related U.S. Application Data

[63] Continuation of Ser. No. 935,779, Aug. 28, 1992, abandoned.

[51] Int. Cl.[6] ..... B07C 5/02; B65H 39/10

[52] U.S. Cl. ..... 209/539; 209/656; 209/900; 209/917; 271/303; 271/305; 198/370.01; 198/442

[58] Field of Search ..... 209/539, 584, 209/651, 652, 655, 657, 656, 900, 917, 918; 271/279, 298, 299, 302, 303, 305; 198/367, 370.01, 436, 437, 442

[56] References Cited

U.S. PATENT DOCUMENTS

| | | | |
|---|---|---|---|
| 1,894,547 | 1/1933 | Tucker | 198/367 X |
| 3,264,917 | 8/1966 | Califano et al. | 271/303 X |
| 3,717,249 | 2/1973 | Faley | 271/302 X |
| 3,724,657 | 4/1973 | Katagiri et al. | 271/302 X |
| 3,750,880 | 8/1973 | Petrovsky et al. | 209/655 X |
| 4,326,636 | 4/1982 | Kawakami | 271/305 X |
| 5,014,975 | 5/1991 | Hamricke | 271/303 X |
| 5,083,769 | 1/1992 | Young, Jr. | 271/303 X |
| 5,135,115 | 8/1992 | Miller et al. | 209/657 X |
| 5,150,894 | 9/1992 | Ricciardi | 271/303 X |

*Primary Examiner*—William E. Terrell
*Assistant Examiner*—Tuan N. Nguyen
*Attorney, Agent, or Firm*—Millen, White, Zelano & Branigan, P.C.

[57] ABSTRACT

A document sorting section for sorting flat documents wherein a plurality of primary document conveying paths are interposed between rows of opposing document stacking elements and document diverters are positioned in the primary paths. Each of the primary conveying paths are in conveying communication with separate diverters and corresponding sorting paths, such as angularly disposed sorting paths, wherein each of the sorting paths is in conveying communication with either of the primary conveying paths, but not both. A primary pivotal diverter, located upstream from the first and second primary conveying paths, diverts documents from the main transport path to either of the primary conveying paths.

9 Claims, 1 Drawing Sheet

DOCUMENT SORTING SECTION HAVING A PLURALITY OF PRIMARY SORTING PATHS

This application is a continuation of application Ser. No. 07/935,779 filed Aug. 28, 1992, now abandoned.

BACKGROUND OF THE INVENTION

The present invention relates generally to devices for sorting documents on-edge and more particularly to document sorting devices which include a sorter section with diverters for diverting flats, such as larger sized postal envelopes, magazines and the like into selected receptacles.

Document processing systems are generally known which convey documents on-edge along a main document transport path and into a sorting section in which the documents may be selectively diverted or sorted according to predetermined criteria such as their particular mail zone destination. Such sorting sections typically have a single primary conveyor path generally defined at least in part by a rectilinear, vertically disposed run of a primary endless conveyor belt.

Sorter sections for sorting flats typically include one or more document diverter or sorter stations which are disposed along both sides of the length of the primary conveyor belt. The sorter stations may each include a secondary conveyor belt having a run inclined to the primary conveyor path, along which a document travels when diverted from the primary converter path. Such document sorter stations may employ a switching roller disposed transverse to the primary conveyor belt which is movable to push the primary belt in a direction to cause a document to deviate from the primary or main conveyor path to a secondary or branch route. Other diverter stations employ pivotally mounted diverter elements.

Also, conventional sorter sections for sorting standard sized envelopes include a plurality of receptacles or stacking bins into which documents are diverted. The plurality of bins are generally formed as a plurality of rows of bins such that one row of bins opposes another row of bins on either side of the single primary conveyor path. The single primary conveyor path is interposed between the rows of opposing bins and must typically transport documents for all of the bins. Each bin typically has a dedicated diverter gate. The diverter gates are typically controlled by a computer or other control mechanism which determines the appropriate bin into which a document should be diverted.

A problem arises with conventional sorter sections having a single primary path for diverting documents since they are typically designed to handle shorter letter sized documents. The pivotal diverters at each sorting section are generally small and bend the shorter letter sized documents from the single primary path to the secondary conveyor belts. However, flats such as magazines and longer, larger envelopes cannot typically be bent as readily as letter sized documents and therefore generally collide or jam in conventional diverter mechanisms.

Other known sorter sections, such as disclosed in U.S. Pat. No. 3,750,880, gang individual sorter sections together. However, these sorters require that each single primary path of each individual sorter section be dedicated to a set of staggeredly opposing bins on each side of the single primary path as generally described above. Again, such systems are typically unsuited to properly transport and sort flats for the reasons described above. Staggered bins may contribute to wasted floor space since an opposing bin must be positioned downstream from an adjacent bin instead of directly across therefrom. In addition, such systems typically require a separate diverter mechanism for each primary path to divert documents into the appropriate individual sorter section. This increases complexity in dual path sorters since a plurality of additional diverters must be controlled in addition to the diverter dedicated for each bin.

Although some sorter sections use longer secondary paths along the single primary path to accommodate flats, the sorting stations are generally positioned along one side of the primary path because of the requisite length and size of the secondary paths and supporting belts. This drastically reduces sorting capacity since bins are not efficiently positioned on both sides of the primary path as with conventional sorters used with standard letter sizes.

SUMMARY OF THE INVENTION

An object of the invention is to overcome the above problems by providing a sorter section for a document conveying system with increased capacity for sorting flats while reducing the probability of collisions between documents.

The inventive sorter section includes a first primary conveying path for conveying certain documents from the main transport path and a second primary conveying path for conveying certain others of the documents from the main transport path. Each of the primary conveying paths are in conveying communication with separate corresponding sorting stations, such as angularly disposed sorting paths, wherein each of the sorting stations is in conveying communication with one of the primary conveying paths, but not both. A primary pivotal diverter, located upstream from the first and second primary conveying paths diverts documents from the main transport path to either of the first and second primary conveying paths. The primary conveying paths are interposed between the separate sorting stations.

The apparatus also includes a row of receiving bins in conveying communication with each of the sorting stations. The sorting station paths convey documents to corresponding receiving bins.

Each of the primary conveying paths are preferably formed in part by an endless belt which is trained about a plurality of rollers. A plurality of secondary diverters, such as pivotal rollers positioned to abut an inside surface of the endless belts, vary the course of travel of the endless belts such that documents transported by each belt are diverted from the primary paths down corresponding secondary conveying paths to the receiving bins.

Further objects, features and advantages of the present invention, together with the organization and manner of operation thereof, will become apparent from the following detailed description when taken in conjunction with the accompanying drawing.

DETAILED DESCRIPTION OF THE PREFERRED EMBODIMENT

Figure 1:
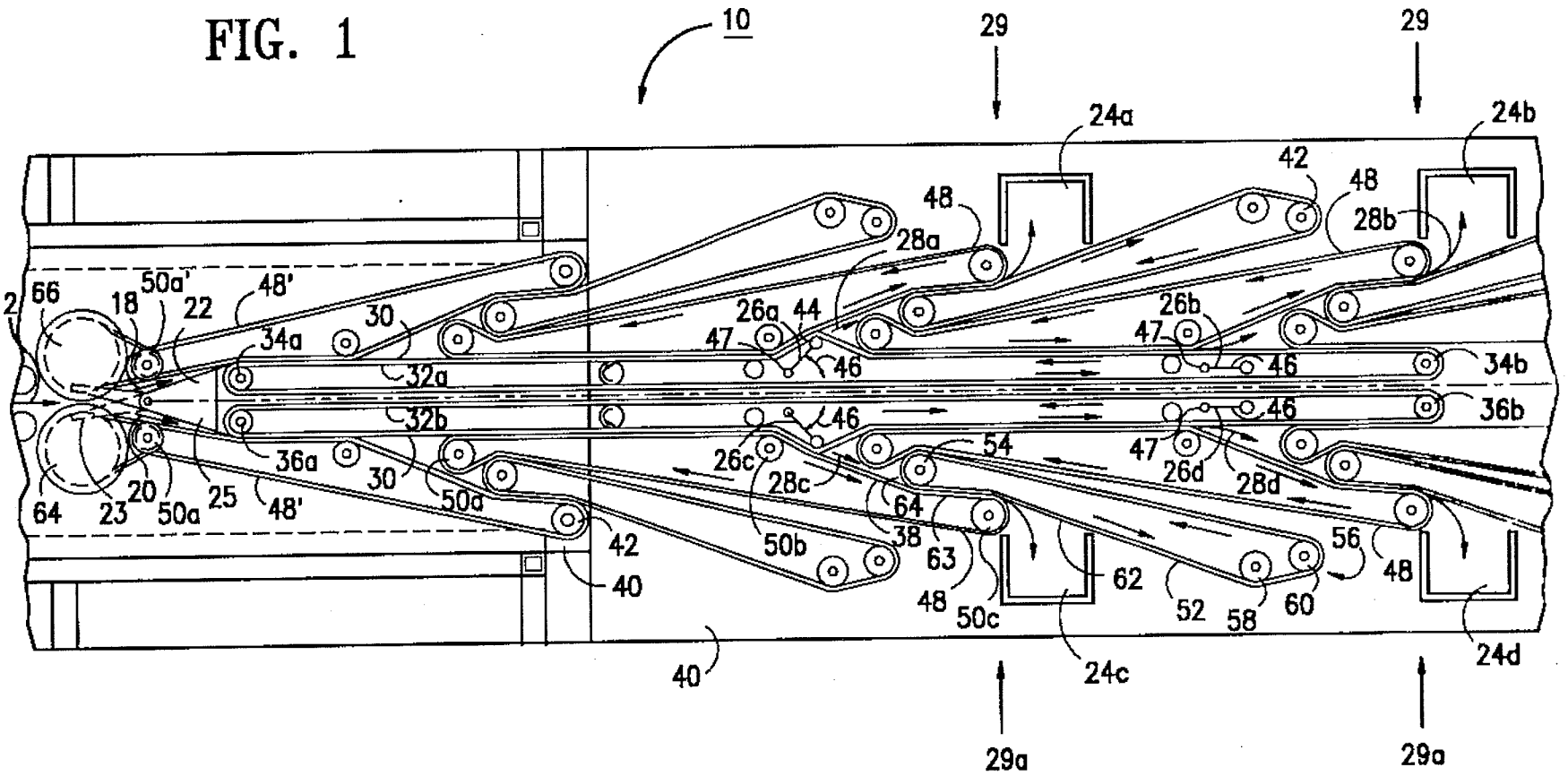
FIG. 1 is a plan schematic view of a sorter section with dual document paths constructed in accordance with the present invention.

FIG. 1 illustrates a sorter section 10 for sorting generally flat documents 11, such as large size, thicker and heavier postal documents and the like, which sorter section may form a portion of a larger system for processing documents.

The sorter section 10 couples at the end of a main document path 12, and includes a first conveying path 18, a second conveying path 20 adjacent and parallel to the first conveying path, a pivotal diverting mechanism 22, a plurality of stacking pivotal diverter mechanisms 26*a*–26*d*, and a plurality of corresponding angularly displaced sorting paths 28*a*–28*d* which are each in conveying communication with one of the corresponding conveying paths 18 or 20. The position of the angularly displaced sorting paths 28*a*–28*d* defines an entrance to each of a plurality of sorting stations generally indicated at 29 adjacent an outer run 30 of each of the document conveying paths 18 and 20. A plurality of corresponding opposing document receiving or stacking bins 24*a*–24*d* into which documents are diverted by the plurality of stacking pivotal diverters 26*a*–26*d* are positioned downstream from each of the sorting paths 28*a*–28*d*.

The pivotal, diverting mechanism 22 diverts documents from the main path 12 to either of the two primary paths 18 and 20. The diverting mechanism 22 is controlled by a microcontroller or other suitable device (not shown) which may also control the operation of the stacking diverters 26*a*–26*d*. The diverting mechanism 22 includes an arm 23 pivotally connected to a stationary base 25 and pivots laterally with respect to the stationary base 25.

Each of the conveying paths 18 and 20 are preferably defined by an endless conveying belt designated 32*a* and 32*b*, but may be formed by a plurality of suitably aligned shorter belt segments, if desired. Each conveying belt 32*a* and 32*b* is trained about a corresponding set of rollers 34*a*–34*b* and 36*a*–36*b* respectively. Idler rollers 37*a*–37*d* are positioned proximate the entrances to the sorting paths 28*a*–28*d*corresponding to each respective receiving bin 24*a*–24*b*. The first and second conveying paths 18 and 20 are shown to lie laterally adjacent to each other, but could diverge if desired.

The sorter section 10 includes a support or base plate 40 upon which a plurality of vertical shafts are mounted, generally indicated at 42. Each shaft 42 has a corresponding roller mounted for rotation about the shaft. For example, the rollers 34*a* and 34*b* and 36*a* and 36*b* and other rollers shown in FIG. 1 rotate about corresponding shafts 42 projecting vertically from the base plate 40.

Each of the plurality of stacking diverters 26*a*–26*d*, which are positioned inside opposing runs of the conveying belts 32*a* and 32*b*, include a pivotal roller 44 mounted to a distal end of a pivot arm 46. The other end of the pivot arm 46 couples to a rotational shaft 47. Each pivotal roller 44 is adapted to be moved counterclockwise, when actuated, about shaft 47, whereby roller 44 engages an inner surface of the outer run 30 of either belt 32*a* or 32*b* and deform the outer run of the belt to form sorting paths 28*a*–*d*. Arrow 46 indicates the rotational movement path of diverters 26*a*–*d*. The diverters 26*a*–26*d* are controlled by a suitable control device generally known in the art (not shown), such as a microprocessor which controls a solenoid or other suitable mechanism, which selectively controls the diversion of a document into the appropriate sorting station 29.

The plurality of angularly displaced sorting paths 28*a*–28*d* are formed in part by a plurality of secondary conveyor belts, four of which are generally indicated at 48. The position of the secondary conveyor belts 48 defines the entrance to each sorter station along the outer run 30 of the primary belts 32*a* and 32*b*, and the belts 48 are supported by three rollers 50*a*–50*c*, respectively. The conveyor belts 48 are dimensioned and arranged to be driven at the same longitudinal speed as each of the primary conveyor belts 32*a* and 32*b*.

Although the following description will be explained with respect to a single sorter station 29*a*, the illustration pertains equally well to all sorter stations since each sorter station employs substantially the same arrangement of document conveying paths and corresponding belts. A document or article diverted from either of the dual conveyor paths 18 and 20, defined in part by the conveyor belts 32*a* and 32*b* and the secondary conveyor belts 48, is conveyed to a corresponding sorting station 29*a* by means of a third conveyor belt 52. The conveyor belt 52 is movably supported on a vertically disposed crowned roller 54 at one end, and a roller and drive assembly 56 at the other end. The roller and drive assembly 56 includes an idler roller 58 and a drive roller 60 to establish a belt run 62 which lies in juxtaposed contacting relation with a portion of the inclined run 38 of the secondary conveyor belt 48 to define secondary paths 28*a*–28*d*.

The roller 54 is positioned to the left of roller 50*c* whereby a portion of the third conveyor belt 52 overlies and contacts a portion of run 38 of belt 48. A nip 64 is created between roller 54 and belt run 38 which engages and advances a document as the document is diverted along the secondary sorting path when the secondary diverter 26*c* is in an actuated position so as to abut the inside surface of the primary belt 32*b* and to divert documents into the sorting path 28*c*.

The drive roller 60 of the roller and drive assembly 56 drives the belt 52 at the same speed, and in an opposite rotational direction, than the belt 28. A document is conveyed along the inclined run of belts 48 and 52 at path 28*c* and is carried by belt 52 to the receiving bin where it is stacked or otherwise grouped as known in the art. A plurality of document receiving bins (not shown) lie adjacent the first primary conveying path and another plurality of document receiving bins lie adjacent the second primary conveying path.

As can be seen, the dual path configuration uses primary belts 32*a*–32*b* interposed between directly opposing sorting stations and respective receiving bins. Each primary path 18, 20 transports documents to only one group of sorting stations adjacent to the corresponding primary path. Therefore, documents from one primary path are not diverted to secondary paths which are in conveying communication with the other primary path.

In operation, entrance drive rollers 64 and 66 drive a belt which engages rollers 50*a* to move belts 48', which are located at the entrance of the sorting section 10 and form the entrance portion of the primary paths 18 and 20. A document travels down the main path 12 and into the sorting section 10. The primary, diverter 22 moves the pivotal arm 23 to allow the document to enter one of the two primary paths 18 or 20. The document is then diverted into the appropriate sorting station by one of the diverters 26*a*–*d*. The document is then transported down the corresponding secondary path and into the appropriate receiving bin 24*a*–*d*.

While a preferred embodiment of the present invention has been illustrated and described, it will be understood that changes and modifications may be made without departing from the spirit and scope of the invention.

What is claimed is:

1. A sorting apparatus with improved capabilities for sorting documents which cannot be bent as readily as letter-sized documents and which have been received from a main transport path comprising:

a first conveying path for selectively conveying a portion of said documents from said transport path to first sorting station means disposed on one side of said first conveying path, said first sorting station means comprising a plurality of sorting paths disposed along the length of said first conveying path;

a second conveying path for selectively conveying the remaining portion of said documents from said transport path to second sorting station means disposed on one side of said second conveying path, said second sorting station means being substantially directly opposed to said first sorting station means and comprising a plurality of sorting paths disposed along the length of said second conveying path;

said first and second conveying paths extending along said sorting apparatus and extending between said first and second sorting station means;

each of said first and second conveying paths including first and second belt means, respectively, extending along the length of each of said conveying paths, said sorting station means including diverter elements spatially disposed along the length of said belt means to selectively deform said belt means at a predetermined location for diverting documents from said first and second conveying paths into one of said first and second sorting station means; and, a single initial diverting means disposed ahead of said first and second conveying paths for selectively diverting documents into either said first conveying path or said second conveying path from said main transport path.

2. The sorting apparatus of claim 1 wherein each of said sorting station means include document receiving means for stacking said documents after said documents emerge from said sorting paths.

3. The sorting apparatus of claim 1 wherein said first and second conveying paths are disposed between said first and second sorting station means.

4. The sorting apparatus of claim 1 wherein said first sorting station means are disposed along an outer run of said first belt means, and said second sorting station means are disposed along an outer run of said second belt means.

5. The sorting apparatus of claim 1 wherein said first and second conveying paths extend longitudinally adjacent each other.

6. The sorting apparatus of claim 1 wherein said diverter elements include pivotal roller means selectively deforming said first and second belt means to divert documents into the respective sorting station means associated with each of said diverter elements.

7. The sorting apparatus of claim 1 wherein said first and second conveying paths extend substantially parallel to each other.

8. The sorting apparatus of claim 6 wherein said pivotal roller means are activated in response to a signal from electronic control means.

9. The sorting apparatus of claim 1 wherein said initial diverting means is activated in response to a signal from electronic control means.

* * * * *